US006139366A

United States Patent [19]

van Woensel

[11] Patent Number: 6,139,366

[45] Date of Patent: Oct. 31, 2000

[54] LATCHED AND SHIELDED ELECTRICAL CONNECTORS

[75] Inventor: Johannes M. B. van Woensel, Rosmalen, Netherlands

[73] Assignee: Berg Technology, Inc., Reno, Nev.

[21] Appl. No.: 09/202,406

[22] PCT Filed: Jun. 11, 1997

[86] PCT No.: PCT/US97/10140

§ 371 Date: Jun. 28, 1999

§ 102(e) Date: Jun. 28, 1999

[87] PCT Pub. No.: WO97/48151

PCT Pub. Date: Dec. 18, 1997

Related U.S. Application Data

[60] Provisional application No. 60/019,799, Jun. 14, 1996.

[51] Int. Cl.[7] ..... H01R 13/648

[52] U.S. Cl. ..... 439/609; 439/108; 439/358

[58] Field of Search ..... 439/358, 328, 439/607, 609, 108

[56] References Cited

U.S. PATENT DOCUMENTS

| | | | |
|---|---|---|---|
| 3,544,951 | 12/1970 | Roberts | 439/358 |
| 4,032,209 | 6/1977 | Rutkowski | 439/358 |
| 5,307,242 | 4/1994 | Seibold et al. | 439/609 |
| 5,494,451 | 2/1996 | Bowers | 439/358 |
| 5,511,992 | 4/1996 | Thalhammer | 439/108 |
| 5,522,731 | 6/1996 | Clark et al. | 439/108 |
| 5,660,557 | 8/1997 | Lemke et al. | 439/358 |
| 5,897,393 | 4/1999 | Haftmann | 439/328 |
| 5,934,939 | 8/1999 | Thenaisie et al. | 439/607 |

*Primary Examiner*—Paula Bradley
*Assistant Examiner*—Tho D. Ta
*Attorney, Agent, or Firm*—Brian J. Hamilla; M. Richard Page

[57] ABSTRACT

A latch member (52) for coupling a connector (48) and header (44) together to provide an electrical connector assembly. The latch member (52) comprises an elongated member (60) having a first end (62) and a second end (64). A fastening segment (68), which can securely engage an outer wall of a header to assist in securing the latch member in an operating position, is intergrally coupled near the second end. At least one latch element, adapted to securely engage and immobilize the connector element in cooperation with the header, is integrally coupled near the first end. The latch member also functions as an electrical shield for the header and the mating connector.

18 Claims, 8 Drawing Sheets

LATCHED AND SHIELDED ELECTRICAL CONNECTORS

This application claims the benefit of application Ser. No. 60/019,799, filed Jun. 14, 1996, and PCT/US97/10140, filed Jun. 11, 1997.

FIELD OF THE INVENTION

The present invention relates generally to cable connectors, and, more particularly, to a latch member for coupling a modular shielded cable assembly and header together to produce an electrical interconnector while reducing electromagnetic interference (EMI) and cross talk between and among closely situated cable connections.

BACKGROUND OF THE INVENTION

High density back panel connectors such as METRAL™ connectors, sold by Berg Electronics, are available in various standardized lengths. Such high density connector have been marketed widely by several companies and are widely known in the industry.

It is generally known in the art, that such connectors are modularized and can be combined and assembled to form connectors having a particular desirable length. Typically, this is accomplished by stacking standard length headers and receptacle connector modules. To form both sides of an electrical interconnection, for example, an assembly module, or cable terminator matching the desired length can be plugged into an assembly of stacked header connectors.

Although stacking such connectors is known in the art, problems remain with regard to combining connectors in this manner. Because the close proximity of the modules and the close spacing of contacts, these systems are susceptible to crosstalk. The connectors may encounter EMI from external sources as well as from each other. Also, inserting a mating module into a series or stack of header connectors is often difficult. Such modular arrangements have in the past provided insufficient guidance mechanisms so as to insure proper connection between mating arrays of modules. Further, assembly modules such as those forming cable connectors often are inadvertently disconnected from the header connector. Thus, prior art connectors lack a reliable means for preventing movement of cable connectors once they are engaged with the composite header.

Another drawback with conventional assembly modules is that they can be inadvertently disconnected from the head connector. It would, therefore, be desirable to provide a means for ensuring that the assembly modules and header connector remain connected.

Therefore, there remains a need for a cable interconnection which minimizes EMI and crosstalk provides sufficient guidance, so as to easily attach an assembly modules to a header connector and provides a means of adequately securing a cable connector to a header connector.

SUMMARY OF THE INVENTION

In the present invention a latch member for coupling interconnectors together to provide an electrical interconnection is provided. The latch member comprises an elongated member having a proximal end and distal end. A fastening segment that is adapted to securely engage an outer wall of a header to assist in securing the latch member in an operating position is integrally coupled proximate the distal end. At least one latch element, adapted to securely engage and immobilize the connector element in cooperation with the header, is integrally coupled proximate the proximal end. The latch member is also configured to provide electrical shielding.

BRIEF DESCRIPTION OF THE FIGURES

The present invention will be better understood, and its numerous objects and advantages will become apparent by reference to the following detailed description of the invention when taken in conjunction with the following drawings, in which.

DETAILED DESCRIPTION OF THE PREFERRED EMBODIMENTS

Figure 1A:
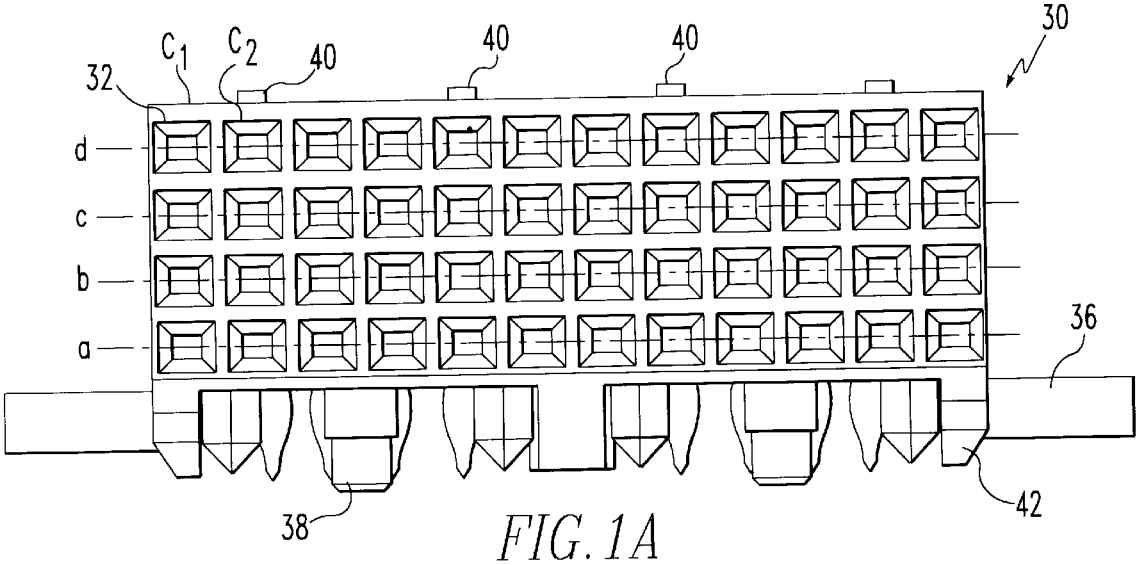
FIG. 1A PRIOR ART
FIGS. 1A through 1D depict a prior art high density, modular receptacle connectors and header connectors.

FIGS. 1A–D. depict a prior art modular, high density receptacle connector 30 and header connector 32, such as the METRAL™ line of connectors sold by Berg Electronics. As shown in FIG. 1A, the receptacle connector 30 includes a matrix of contact terminals 32 mounted within a housing and electrically connected to tails 34. It is noted that the receptacle connector 30 as depicted constitutes only two of several receptacle connector modules which can be stacked together, side to side. The distance between the center of any two adjacent rows (e.g. row a and b) of terminals 32 is 2 mm, for example. Similarly, the distance between the center of any two adjacent columns (e.g. $C_1$ and $C_2$) of terminals 32 is 2 mm, for example. Thus, the illustrated receptacle modules define a 2×2 mm terminal grid pattern. Receptacle connectors 30 typically are made in modules having six columns and are therefore 12 mm in length. Although the receptacle 30 shown in FIG. 1A has four rows of terminals 32, it will be understood that the number of terminal 32 rows may vary. Generally, the basic receptacle connector module contains five rows and six columns and is referred to as a 5×6 receptacle module. The description that follows assumes a 5×6 receptacle connector.

Figure 1B:
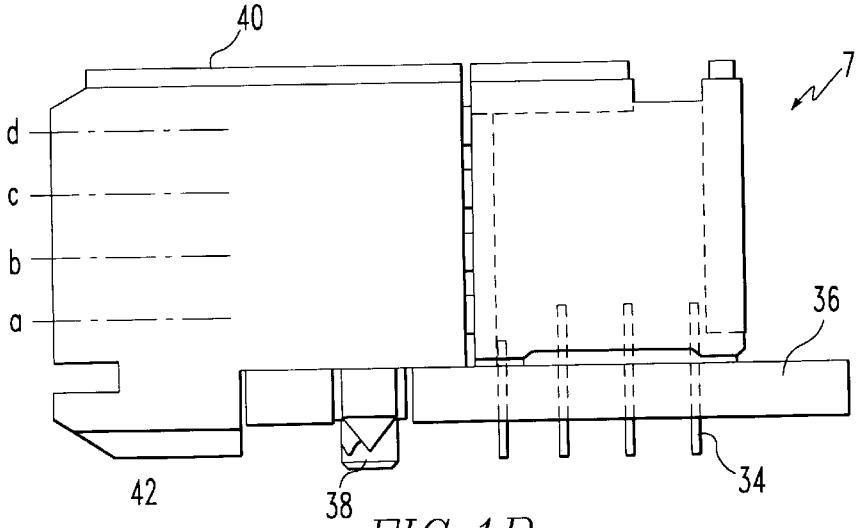
FIG. 1B PRIOR ART

FIG. 1B provides a side view of the receptacle connector 30. The receptacle connector 30 is characterized by dual beam contact terminals attached to right angle bent tails 34, which are thru-mount or press-fit to a circuit substrate such as printed circuit board 36. Additionally, fixing pegs 38 are provided on opposite sides of the receptacle connector 30.

Figure 1C:
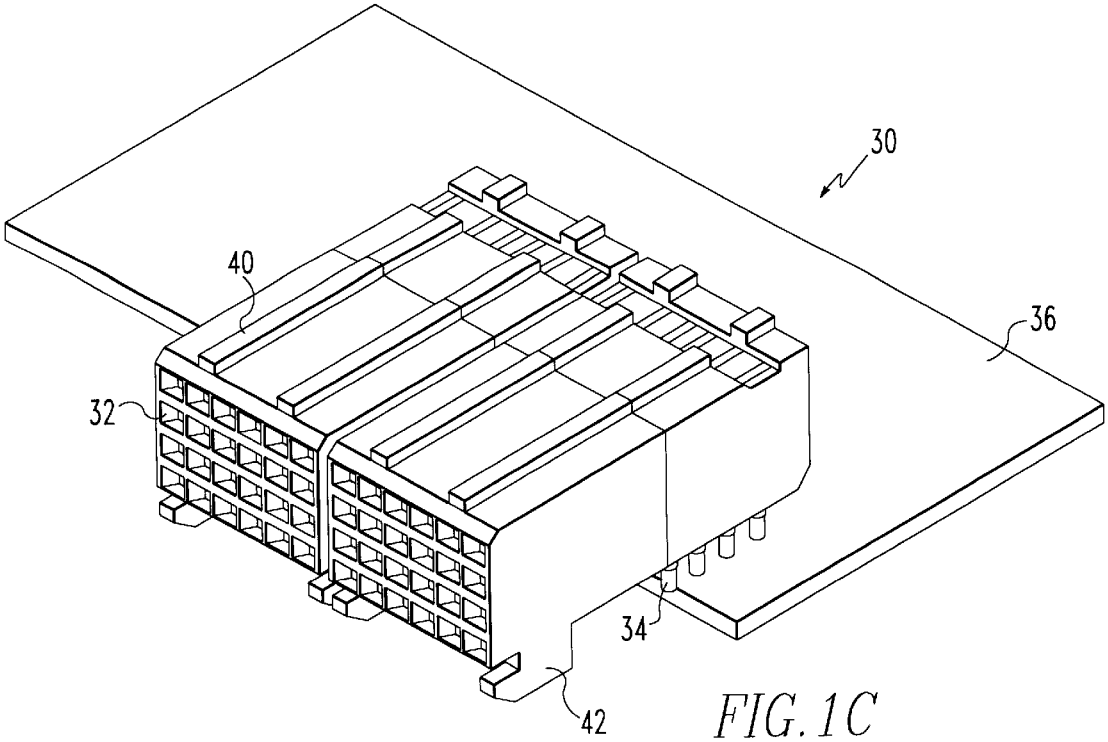
FIG. 1C PRIOR ART

FIG. 1C provides an elevated perspective view of the receptacle connector 30. The receptacle connector 30 has two raised rails 40 on one side with two polarizing latch ears 42.

Figure 1D:
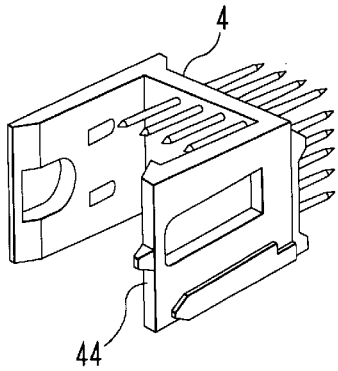
FIG. 1D PRIOR ART

FIG. 1D is a view of a prior art straight through header connector 44. The portion of the terminal pins 43 extending from rear 46 of the header connector 44 are adapted to be received by the terminals 32. Similar to the receptacle connector 30, header connectors may vary in size but typically are 5×6 in dimension so as to cooperate with the receptacle connectors 30 of similar dimension. A straight through header 44 can be used to convert the receptacle connector 30 into a pin header for accepting a mating receptacle connector, that are commonly used for cable termination. Alternatively, the combination of the right angle receptacle 80 and straight through header may be replaced with a right angle pin header.

Figure 2:
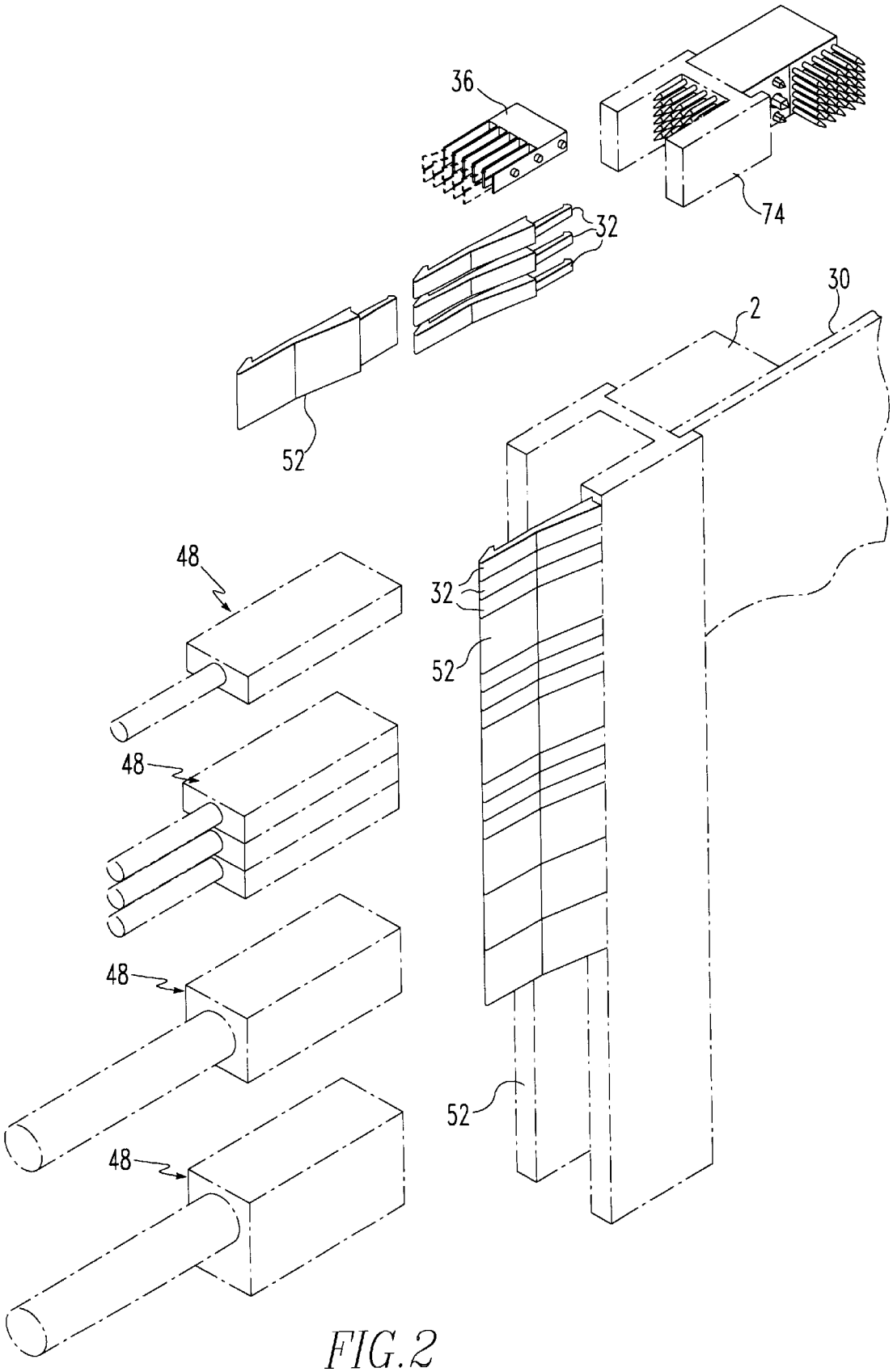
FIG. 2 provides a partially exploded view of a stacked arrangement of shielded cable connectors and header connector modules placed one on top of the other, and a latch member in accordance with the present invention for coupling the cable connectors and header connectors.

FIG. 2 shows a stacked arrangement of shielded cable connectors 48, header connector modules 50 stacked one on top of the other, and a latch member 52 in accordance with the present invention for coupling the shielded cable connectors and header connectors. Preferably the header connectors are also shielded.

As shown, the shielded housing 54 is supported around an assembly module 56 to form the shielded cable connector 48. Alternatively, several assembly modules 56 may be enveloped together in a single shielding housing to form the complete cable connector. The shielded housing 54 is made from an alloy which is environmentally acceptable and which provides sufficient insulating qualities so as to minimize EMI and crosstalk. The shielded housing 54 is made from beryllium copper with a thickness of about 0.15 mm. Other suitable materials could alternatively used. Also shown, the latch member 52 of the present invention can likewise vary to accommodate the various combinations of assembly modules, e.g. 5×6.

Figure 3:
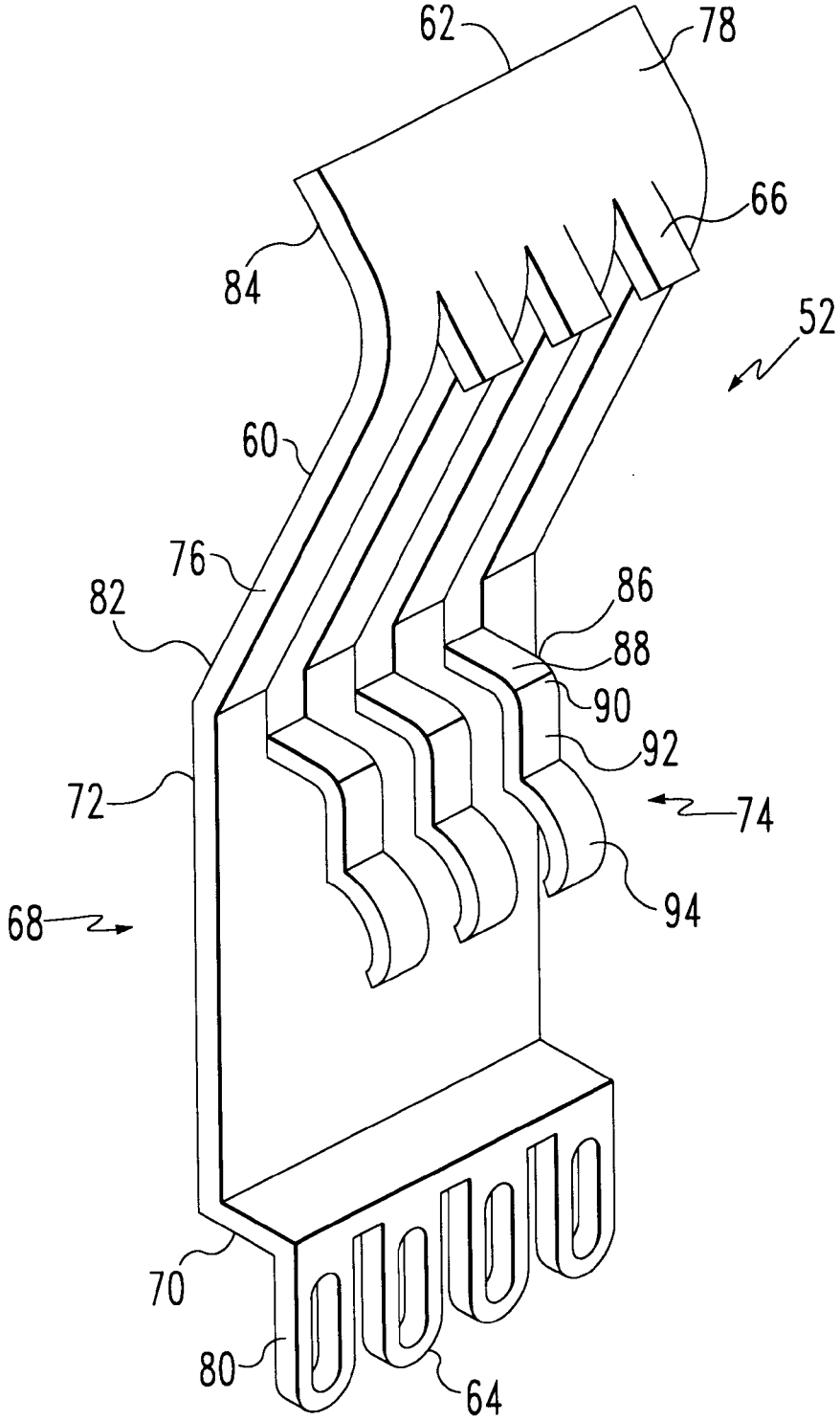
FIG. 3 is a perspective view of the latch member shown in FIG. 2.

FIG. 3 shows the latch member 52 in more detail. The latch member comprises an elongated member 60 having a proximal end 62 and distal end 64. A latch element 66, adapted to securely cooperate with the shielded cable connector 48, is provided proximate the proximal end 62. The operation of the latch element 66 is discussed in more detail below. A fastening segment 68 that is adapted to securely cooperate with the outer wall of a header is provided proximate the distal end 64 of the elongated member 60. The fastening segment 68 is discussed next.

Preferably, fastening segment 68 comprises a stepped portion 70, body portion 72, and a portion of a contact member 74. The stepped portion 70 is formed at the distal end 64 of the elongated member 60 and is adapted to engage the header to assist in retaining the latch member 52 to the header. The way that stepped portion 70 engages the header is discussed in more detail below.

Preferably, the stepped portion 70 cooperates with a termination member 80. The termination member 80 is adapted to electrically cooperate with a ground path on a printed circuit board (PCB). The termination member 80 may be a press fit or solderable pin or a surface mount tab which is adapted to be coupled with a PCB. It is noted that the termination member 80 may be placed at other locations on the latch member 52 so long as it can electrically cooperate with a grounding means on the PCB. On the opposite end of termination member 80, the stepped portion 70 cooperates with and blends into the body portion 72.

The body portion 72 advances away from the stepped portion 70 towards the proximal end 62. The body portion 72 is formed such that it can abuttingly engage a portion of a header. Preferably, the body portion 72 is formed with a relatively flat surface such that the body portion 72 can abuttingly and securely engage a portion of a header that is of a similar surface profile. The way that the body portion engages a header is discussed in more detail below. The body portion effectively acts as a part of an electrical shield to shield the header 44. As the body portion 72 advances towards the proximal end it cooperates with and is integral with section 76 which is cantilevered from body portion 72 when latch 52 is mounted on a header.

The cantilever section 76 extends away from the body portion 72 towards the proximal end 62. Preferably, the cantilever section 76 extends away from the body portion 72 at a relatively acute angle. The angled cantilever section 76 acts as a cantilever when the body portion 72 engages a header sidewall, i.e. has a relative fixed end 82 and a relative free 84 end that can be displaced. The relative fixed end 82 is formed at an area proximate to where the body portion 72 and cantilever section 76 blend into one another. The free end 84 is located at an area proximate to where the cantilever section 76 and lead-in portion 78 cooperate with and blend into one another. The way that the cantilever section 76 operates is discussed in more detail below.

The lead-in portion 78 extends away from the cantilever section 76 at a relative obtuse angle. The lead-in portion 78 is adapted to guide a shielded assembly module into engagement with a header. The lead-in portion defines at least one latching element 66 which is adapted to engage a shielded assembly module to securely maintain the shielded assembly module in electrical contact with a header. The way that the latching element 66 maintains the module assembly in an operating position is discussed in more detail below.

A contact member 74 is provided proximate to the point that the body portion 72 and cantilevered section 76 blend into each other. The contact member 74 comprises a contact arm 86 that has a relatively short flat laterally extending portion 88 and a relatively downwardly acute extending portion 90. Preferably, the relatively downwardly extending portion 90 blends into a relatively flat downwardly extending longitudinal retaining ear 92. The retaining ear 92 blends into a contact section 94 which is adapted to engage a shield on a shielded cable connector 48 to provide a grounding path. The contact arm 86, contact section 94, and retaining ear 92 are adapted to engage portions of a header to assist in securing the latch member 52 to the header. The way that the contact arm 86, contact section 94, and retaining ear 92 engage the header to provide this function is discussed in more detail below. Additionally, the way that the contact section 94 engages the electrical contact element of the shielded assembly module 48 is discussed in more detail below.

Preferably, the latch member 52 is a one-piece member made of sheet metal having appropriate conductive, strength, elasticity, and corrosion resistant properties. The latching elements 66 and contact elements 24 may be lanced from the one piece sheet member and bent to the shapes shown in Figure. Alternatively, the latch member 52 may be made from individual separate elements that are attached by bonding methods or molded to form an appropriate latch member. The components of the latch member 52 are all integrally coupled and cooperate with each corresponding component in either the one-piece form or separate elements form.

Figure 4:
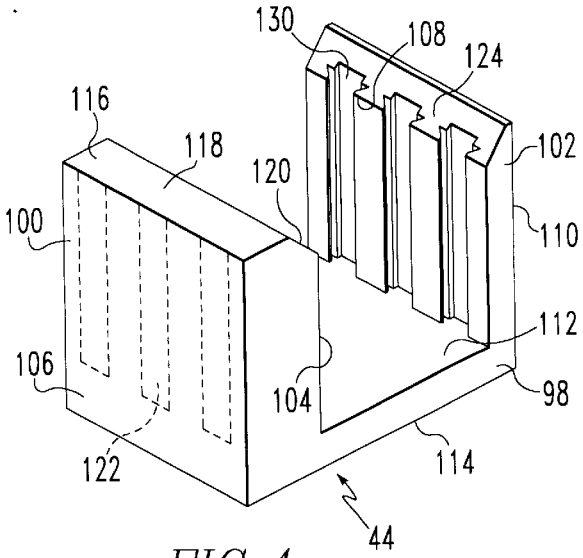
FIG. 4 is a perspective view of a header housing that may be employed with the latch member shown in FIG. 3.

FIG. 4 shows the header 44 that may be employed with the latch member 52. Typically, a plurality of rows and columns of pins extend generally perpendicularly through the base 98. The pins have been omitted from this and other drawings for clarity. The header 44 comprises two upstanding opposing sidewalls 100 and 102 that are separated by, and generally perpendicular to the base 98. The first sidewall 100 has a first inner surface 104 and first outer surface 106. The second sidewall 102 has a second inner surface 108 and a second outer surface 110. The base 98 has an upper surface 112 and bottom surface 114.

The first sidewall 100 has a top surface 116 that defines a generally laterally extending flat portion 118 that begins from the first outer surface 106 and merges into a relatively inwardly angled first truncated surface 120 that blends into the first inner surface 104. The first inner surface 104 defines a first set of longitudinally extending grooves 122 that are spaced apart and parallel to one another (shown in phantom). Each groove 122 extends substantially from the top of the inner wall 104 to upper surface 112 of the base 98.

Generally, the first outer surface 106 is adapted to cooperate with the body portion 72 of the latch member 52, while the flat surface 118, first truncated surface 120, and grooves 122 are adapted to cooperate with a corresponding contact member 74. The way that the latch member 52, first outer surface 106, flat surface 118, first truncated surface 120, and grooves 122 cooperate with one another is discussed in more detail below.

The second sidewall 102 has a relatively inwardly angularly formed second truncated surface 124 that begins from the second outer surface 110 and slopes downwardly until reaching the second inner surface 108. The second inner surface 108 defines a second set of longitudinally extending grooves 130 that are spaced apart and parallel to one another. Each groove 130 extends substantially from the top of the second inner surface 108 to the upper surface 112 of the base 98.

Figure 5:
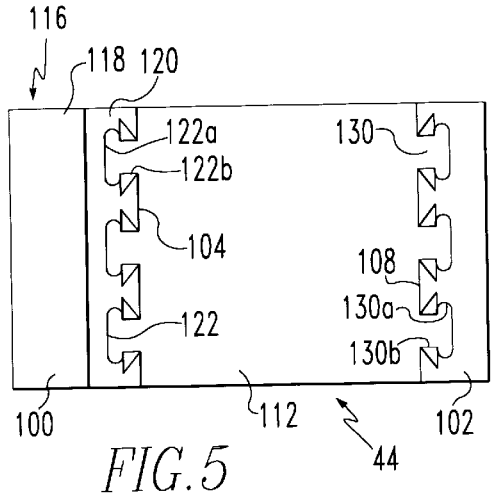
FIG. 5 is a planar view of the header housing shown in FIG. 4.

FIG. 5 is a top view of the header 10 and illustrates the first and second sets of grooves 122 and 130 in more detail. As shown, three grooves are formed in the inner surface 104, 108 of each sidewall 100, 102. The first and second sets of grooves 122 and 130 are adapted to cooperate with a shielded assembly module to guide the shielded assembly module into electrical contact with a header. The header may be formed of an insulative material or a conductive material. Each groove 122, 130 is formed in a two step configuration with inner groove portions 122*a*, 130*a* respectively and outer groove portions 122*b*, 130*b* respectively. The width and depth of inner groove portions 122*a* and 130*a* are dimensioned to receive the contact member 74 of latch member 52. The width and depth of outer groove portions 122*b* and 130*b* is dimensioned to receive contact/guide members of a mating connector, as will be later described.

Figure 6:
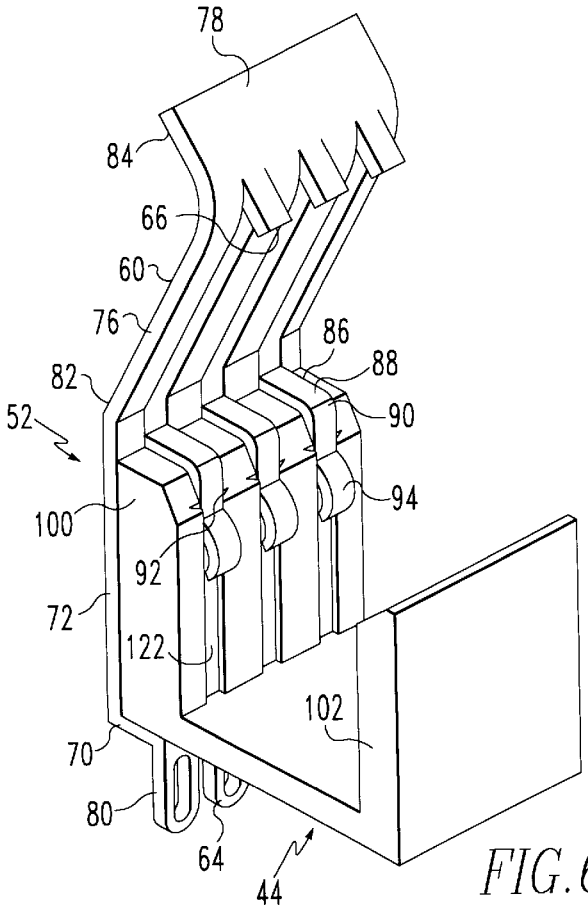
FIG. 6 is a perspective view of the latch member shown in FIG. 3 removably coupled with the header housing shown in FIG. 4.

FIG. 6 shows the latch member 52 removably coupled along the first outer surface 106 of the first sidewall 100. The stepped portion 70 engages the bottom surface 114 of the base 98 with the termination member 80 extending longitudinally downward therefrom. The body portion 72 is positioned substantially flush against the first outer wall 106 of the header 44 with the contact member 74 engaging the top surface 116 of the first sidewall 106. Specifically, the contact member 74, contact arm 86 and the laterally extending portion 88 of the contact arm 86 engage the substantially flat top portion 118 of the top surface 116, while the relatively downwardly acute extending portion 90 of the contact member 74 cooperates with the first truncated surface 120. The retaining ear 92 cooperates with a corresponding groove to aid in coupling the latch member 52 with the header 44. Preferably, the stepped portion 70, body portion 72, and contact member's 74 laterally extending portion 88, relatively downwardly acute extending portion 90 and retaining ear 92 are formed at substantially the same relative geometric shape and angles as the portions of the header 44 that are engaged, thereby providing a snug fit between the latch member 52 and header 44.

As the stepped portion 76, body portion 72, contact arm 86, and retaining ear 92 engage the first outer surface 106, the contact section 94 protrudes therefrom to electrically contact with a portion of the shield module assembly to provide a grounding path. The way that the contact section 94 provides this path is discussed in more detail below.

Figure 7:
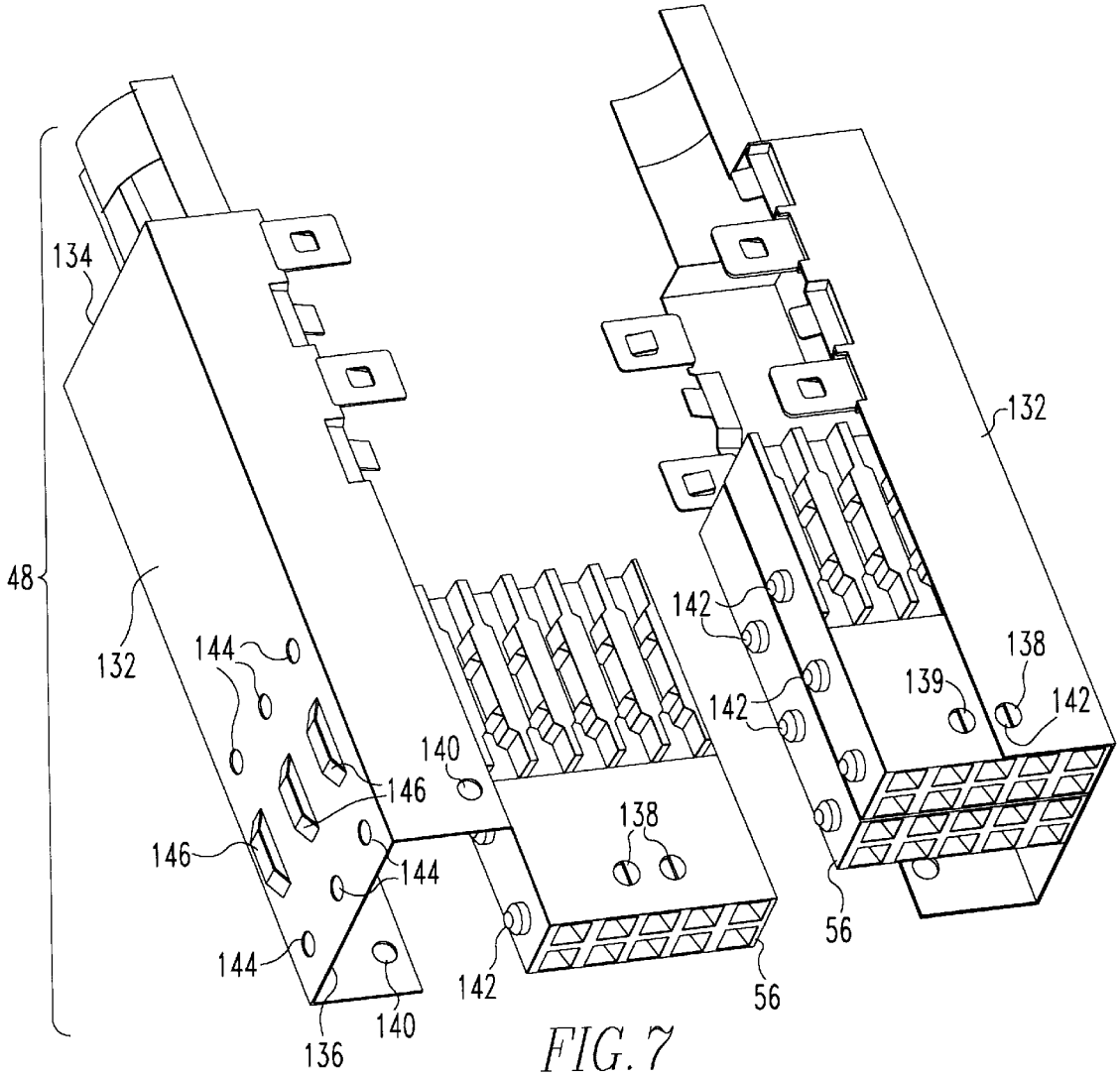
FIG. 7 is an exploded view of the shielded modular cable connector shown in FIG. 2.

FIG. 7 broadly shows the shielded cable connector 48 that may be employed with the latch member 52 in accordance with the present invention. The shielded assembly module 48 is described in more detail in copending international application Ser. No. PCT/US97/10063, entitled Shielded Cable Connector, to VAN WOENSEL, filed on Jun. 5, 1997 (Attorney Docket No. EL-6149P) and is hereby incorporated by reference in its entirely. The shielded cable connector 48 comprises two half shells 132 formed around three assembly modules 56. The shielded assembly module 48 has a top surface 134 and bottom surface 136. A lateral stud 138 cooperates with a lateral recess 140 so as to secure the half shells 132 to the assembly modules 56. A side stud 142 on each module 56 protrudes through side recesses 144 and cooperates with a raised dimple recess 146 on each shell 132 so as to insure that each module 56 is properly seated in each shell.

The raised dimple recess 146 and the studs 142 protruding through the side recesses 144 also function to guide the shielded assembly module 48 into the header 44. The protruding side studs 142 and the dimple recess 146 are adapted to cooperate with the grooves 122 and 130 located in the header connector side walls to provide a guide for relatively easy insertion of the shielded assembly module into the header connector 44. Additionally, raised dimple recesses 146 and protruding studs are adapted to engage the contact member 74 on the latch member 52.

Figure 8:
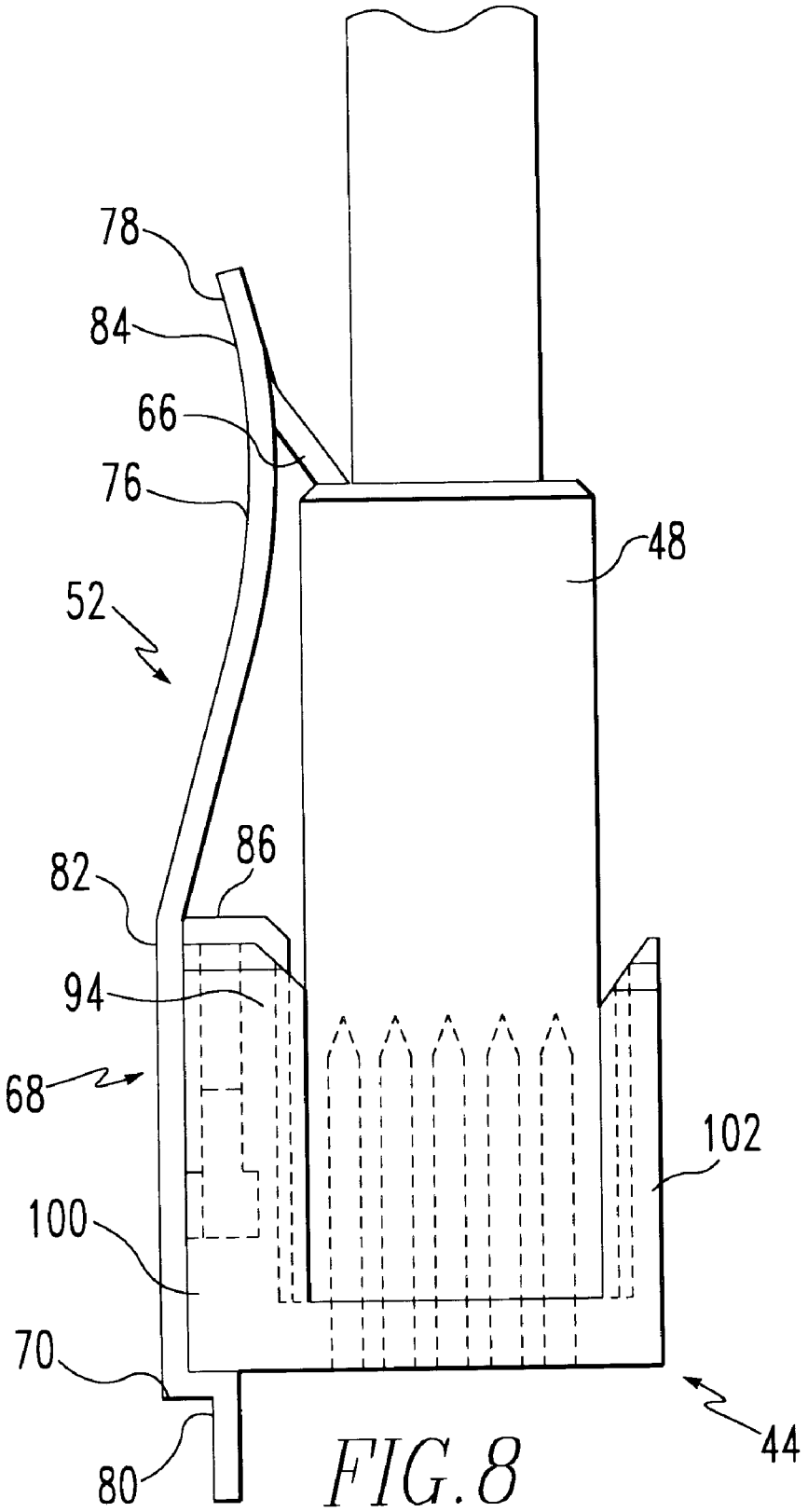
FIG. 8 is a side view of the latch member shown in FIG. 4 in operation with the header shown in FIG. 5 and the shielded assembly module shown in FIG. 7.

FIG. 8 broadly shows the latch member 52 in operation. The latch member 52 is removably coupled to the outer surface 106 of the first sidewall 100 of the header 44 as discussed above in conjunction with FIG. 6. The shielded cable connector 48 is manipulated until the bottom surface 136 engages the top of the lead-in portion 78 of the latch member 52. The lead-in portion 78 guides the connector 48 past the latch elementing 30 as the cantilever section 76 deflects until the raised dimple recesses 146 and protruding side studs 142 are initially received in and cooperate with the outer groove portions 122*b* and 130*b*. Once the raised dimple recesses 146 and side studs 142 are positioned within the outer groove portions, they continue to move along the grooves during which the module assemblies electrically contact the header pins. As the electrical contact is made, the side studs 142 and raised dimple 146 engage the contact section 94 of the contact member 74 to provide a grounding path.

At the final insertion position, the cantilever section 76 returns substantially back to its original position such that the latching elements 66 securely engage the top surface 134 of the cable connector 48 to mold the shielded assembly module in position with the header 44.

The present invention provides several advantages over the conventional connectors. One advantage is that the latch member and shield module assembly substantially eliminate or prevent EMI and cross talk between the relatively closely packed modules. Another advantage is that the lead-in member enables the dimples and studs on the shield module assembly to relatively easily engage the header grooves such that the module assembly properly engages the header pins to provide electrical contacts. Another advantage of the present invention is that the latch member immobilizes the relative movement of the header and the shielded assembly module and thereby prevents inadvertent disconnection of the shielded assembly module from the header connector. Also, the latch member can be easily associated with a standard header module, such as module 44, when it is desired to adapt the header to receive a cable connector. The latch member also acts as an electrical shield to shield the header and the connector received in the header.

Figure 9:
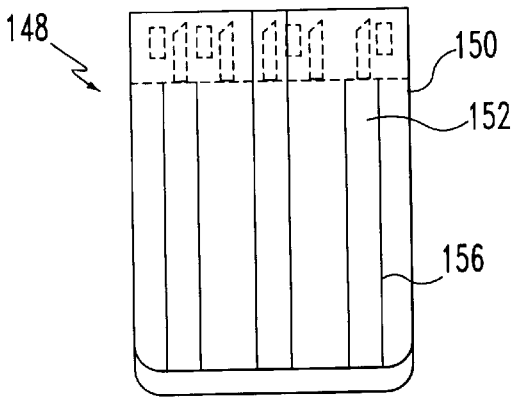
FIGS. 9 through 11 are various views of another header embodiment that may be employed with the latch member shown in FIG. 3.
Figure 10:
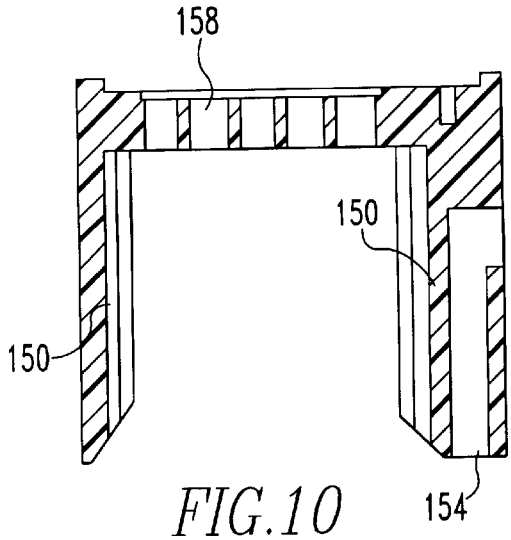
Figure 11:
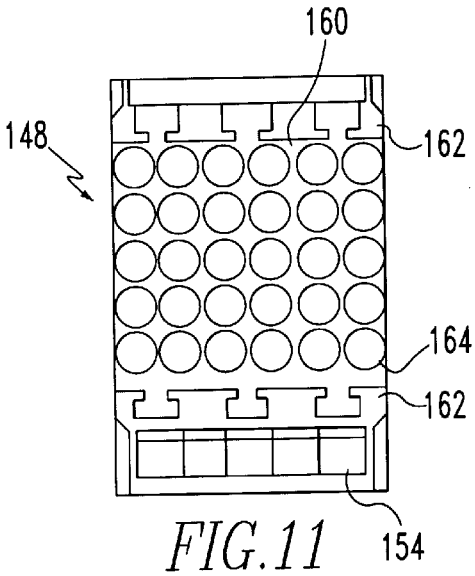

FIGS. 9 through 11 show various views of a shielded header 148 that may be employed with the latch member 52. The header 148 is a 5×6 module. FIG. 9 provides a view of the interior of a side wall 150 of the header 148. The header 148 has three grooves 152 on the interior side walls which are adapted to receive the raised dimple recesses 146 and protruding side studs 142 located on the exterior of a shielding module assembly 48 and thereby guide the shielding module assembly into the correct location within the header connector 148.

FIG. 10 provides a sectional view of the header 148. As shown, one side wall 154 of the header connector contains a slot 156 that is adapted to securely receive a leg portion 158 of another type of connecting latch (not shown).

FIG. 11 provides an end view of the header connector 148 from the perspective of one looking into the base terminal wall of the header connector 148. As shown, the base wall 160 has multiple terminals 162 extending therefrom. The terminals are in a 5×6 arrangement. A series of ground springs 164 are positioned along the sides of the terminal walls between each row of terminals on the base wall.

The latch member 52 in accordance with the present invention is coupled with header 148 in the same manner discussed above in conjunction with FIG. 6. The latch member is coupled on the outer surface of the sidewall 154 which defines the slots 156.

The following application is related to U.S. Provisional Application No. 60/019,799, filed Jun. 14, 1996 and entitled "Integral Latch And Shield" and is hereby incorporated by reference in its entirety.

The present invention may be employed in other specific forms without departing from the spirit or essential attributes thereof. For example, any number of materials may be used in manufacturing the disclosed latch member. While the invention has been described and illustrated with reference to specific embodiments, those skilled in the art will recognize that modification and variations may be made without departing from the principles of the invention as described hereinabove and set forth in the following claims.

I claim:

1. A latch member for coupling a connector element and a header together to provide a electrical connector assembly, said latch member comprising:

an elongated member having first and second ends, said elongated member further comprising:

a fastening segment adapted to securely engage an outer wall of the header to assist in securing said latch member in an operating position, said fastening segment integral with said first end and comprising a stepped portion proximate said first end to engage a portion of the header, said stepped portion electrically coupled with a termination pin which is adapted to provide a grounding path; and at least one latch element adapted to securely engage and immobilize the connector element in cooperation with the header, said latch element being integrally coupled proximate said second end.

2. The latch member in claim 1 further comprising:

a lead-in section integral with said at least one latch element, said lead-in portion adapted to direct the connector element into engagement with the header.

3. The latch member in claim 1 wherein said latch member is a unitary element made of a sheet material.

4. The latch member in claim 1, wherein said fastening member further comprises:

at least one contact member integral with said elongated member, said contact member adapted to securely engage a portion of the header and provide an electrical contact with the connector element.

5. The latch member in claim 4, wherein the latch member is a unitary element made of a sheet material and the at least one contact member is formed from a bent portion of the sheet material.

6. The latch member in claim 4, wherein said fastening segment further comprises:

a body portion cooperating with said stepped portion, said body adapted to engage a portion of said contact member to assist in securing the latch member to the header.

7. The latch member in claim 6 further comprising:

a cantilevered section cooperating with said body portion and extending away from the body portion towards the first end and integral with said at least one latch element, said cantilevered section adapted to have a relative fixed end and a relative free end that is adapted to be displaced and enable the at least one latch element to securely engage the connector element after said at least one latch element is coupled with the header.

8. A latch member for coupling a connector element and a header together to provide an electrical connector assembly, said latch member comprising:

an elongated member having:

first and second ends;

a stepped portion proximate said second end, said stepped portion adapted to securely engage an outer wall and a bottom of the header;

a cantilevered section extending away from the stepped portion towards the first end;

a contact member integral with said cantilevered section; and a lead-in portion defining at least one latching element, said lead-in portion integral with said cantilevered section, said lead-in portion adapted to guide the connector element into engagement with the header.

9. The latch member in claim 8 further comprising:

a termination member electrically cooperating with said latch member, said termination member adapted to electrically cooperate with a grounding feature on a printed circuit board.

10. The latch member in claim 9 wherein said termination member is adapted to be press fit into the printed circuit board.

11. The latch member in claim 10 wherein said termination member is adapted to be soldered to the printed circuit board.

12. A latch member for coupling a connector element and a header together to provide an electrical connector assembly, said latch member comprising:

an elongated member having:

first and second ends;

a stepped portion proximate said second end, said stepped portion adapted to securely engage an outer wall of the header;

a cantilevered section extending away from the stepped portion towards the first end;

a contact member proximate said cantilevered section and comprising:

a contact arm having a laterally extending portion and a downwardly extending portion;

a retaining ear, said retaining ear integral with said downwardly extending portion; and a contact section which is adapted to engage an electrical contact element on the connector element to provide a grounding path, said contact section integral with said retaining ear, wherein said contact arm, contact section, and retaining ear are adapted to engage portions of the header to assist in securing the latch member to the header; and a lead-in portion defining at least one latching element, said lead-in portion integral with said cantilevered section, said lead-in portion adapted to guide the connector element into engagement with the header.

13. An electrical connector comprising:

a housing having a base and at least one sidewall extending from the base, said at least one sidewall having an inner surface disposed adjacent the base and an outer surface opposite the inner surface;

a latch member having a body portion extending along the outer surface of the at least one sidewall and a latch arm extending from the body portion for latching an intermating connector to the housing; and retention structure extending into the inner surface of the at least one sidewall for securing the latch member onto the housing.

14. An electrical connector as in claim 13, wherein the latch member further comprises circuit connecting elements for connecting the latch member to circuit elements on a circuit board.

15. An electrical connector as in claim 13, wherein the retention structure comprises at least one contact element associated with the latch member.

16. An electrical connector as in claim 15, wherein a groove is disposed on said inner surface and the at least one contact element comprises an elongated element received in the groove.

17. An electrical connector as in claim 16, wherein the latch member is unitarily formed of sheet material.

18. An electrical connector for engaging a mating connector, the connector comprising:

a housing;

electrical terminals in the housing;

an electrically conductive latch member positioned along an outer wall of the housing and in shielding relationship to a portion of the housing;

structure on the latch member for electrically connecting the latch member to a circuit substrate on which the connector is to be mounted; and an extension integral with the latch member and extending inwardly for electrically connecting the latch member to the mating connector.

* * * * *